US006966281B1

(12) United States Patent
Hale et al.

(10) Patent No.: US 6,966,281 B1
(45) Date of Patent: Nov. 22, 2005

(54) INTERNAL COMBUSTION DEVICE AND METHODS OF USE

(76) Inventors: James R. Hale, 603 Dundee, Victoria, TX (US) 77904; Clifford M. Davis, P.O. Box 490, Pettus, TX (US) 78146

( * ) Notice: Subject to any disclaimer, the term of this patent is extended or adjusted under 35 U.S.C. 154(b) by 0 days.

(21) Appl. No.: 10/883,449

(22) Filed: Jul. 1, 2004

Related U.S. Application Data

(60) Provisional application No. 60/568,768, filed on May 5, 2004.

(51) Int. Cl.[7] ..... F02N 17/053
(52) U.S. Cl. ..... 123/46 SC; 123/179.19
(58) Field of Search ..... 123/46 H, 46 SC

(56) References Cited

U.S. PATENT DOCUMENTS 2,123,711 A * 7/1938 Callsen ..... 123/179.19
3,610,217 A * 10/1971 Braun ..... 123/46 A
3,981,229 A 9/1976 Breisch et al.
4,145,889 A 3/1979 Breisch
5,314,329 A 5/1994 Lockwood
6,244,226 B1 * 6/2001 Berlinger et al. ..... 123/46 R

* cited by examiner

*Primary Examiner*—Henry C. Yuen
*Assistant Examiner*—Arnold Castro
(74) *Attorney, Agent, or Firm*—George S. Gray

(57) ABSTRACT

An internal combustion device is provided for starting a parent engine, the device having a frame having a piston in a cylinder forming a combustion chamber, the frame further having an air passage and a fuel passage for receiving air and fuel into the combustion chamber. A rod connects the piston to a gear train, the gear train being operationally connected to a crankshaft of the parent engine. An ignition mechanism is operationally connected to the combustion chamber for initiating a combustion process using the received fuel and air within the combustion chamber. The piston is driven one power stroke, causing the crankshaft of the parent engine to rotate. A fuel subsystem utilizing a conventional, replaceable compressible fuel canister. Air forced from the cylinder on the piston is routed to the combustion chamber for purging the combustion chamber of spent gases, and mixing with subsequent fuel gas entry.

14 Claims, 11 Drawing Sheets

INTERNAL COMBUSTION DEVICE AND METHODS OF USE

REFERENCE TO PRIOR APPLICATIONS

This application claims the benefit of the filing date of provisional application 60/568,768, filed in the United Stated Patent & Trademark Office on May 5, 2004, by the above-named inventors.

BACKGROUND OF THE INVENTION

1. Field of the Invention

The field of the invention is internal combustion engines, and more particularly, the use of a smaller internal combustion device to start a larger internal combustion engine.

2. Description of Related Art

A typical small internal combustion engine, such as that on a lawn mower, has a rope starter that rotates the engine's crankshaft, which starts the engine. Electric starters are also used to rotate the crankshaft for the same purpose. Once the crankshaft is rotated both these starters are separated from the crankshaft. The rope starter requires physical exertion that is unacceptable to many users, while the electric starter requires relatively expensive and complicated apparatus. What is needed is a simple and inexpensive device for rotating the internal combustion engine's crankshaft such that the engine starts. The device should require no battery or external electric power, and should be scalable to internal combustion engines of various sizes.

SUMMARY OF THE INVENTION

Our invention provides a simple and inexpensive internal combustion device that is adaptable for rotating an internal combustion engine's crankshaft such that the engine starts. Our device provides a hand-initiated fuel source and igniter that are operationally connected to a cylinder with a piston. Our device fires once, forcing the piston to move a connecting rod that extrudes from the device and is operationally connected to the internal combustion engine's crankshaft, the movement of the connecting rod rotating the crankshaft to the extent necessary to start the engine. Our internal combustion device requires no battery or external electrical power, and is scalable to internal combustion engines of various sizes.

In an exemplary embodiment of our invention, we have provided an internal combustion device for starting a parent engine, the parent engine having a crankshaft, comprising: a frame having a cylinder and a piston in the cylinder forming a combustion chamber, the frame further having an air passage and a fuel passage for receiving air and fuel into the combustion chamber; a rod interconnecting the piston to a gear train, the gear train being operationally connected to a crankshaft of the parent engine; and an ignition mechanism operationally connected to the combustion chamber, the ignition mechanism for initiating a combustion process using the received fuel and air within the combustion chamber, wherein the piston is driven one power stroke within the cylinder, causing the crankshaft of the parent engine to rotate. In some exemplary embodiments, the cylinder has a lower end and an upper end, and further wherein the piston within the cylinder forms a purge chamber, the device further comprising a purging air shroud about the cylinder forming a purged air conduit, the purged air conduit extending from the lower end of the cylinder to the upper end of the cylinder, such that air purged from the purging chamber enters the purged air conduit and flows through the conduit into the combustion chamber. In some exemplary embodiments, the device further comprises a resilient bias member operationally connected to the rod such that the piston is biased to return from a second position in the cylinder lower end, to a first position in the cylinder upper end. In some exemplary embodiments, the device further comprises a decoupling mechanism operationally connecting the gear train to the crankshaft of the parent engine such that as the parent engine begins to rotate independently the gear train is decoupled from the parent engine. In some exemplary embodiments, the device further comprises a fuel subsystem in operative communication with the frame wherein a controlled amount of fuel is supplied into the combustion chamber. In some exemplary embodiments, the device further comprises an actuator assembly operationally connected to the fuel subsystem for causing the fuel subsystem to deliver the fuel to the combustion chamber for mixture with the air in the combustion chamber, and operationally connected to the ignition mechanism for causing the ignition mechanism to ignite the fuel-air mixture. In some exemplary embodiments, the piston travel, following combustion, compresses air in the purging chamber, forming an air buffer for controlling piston speed during the power stroke.

Some exemplary embodiments of our invention provide an internal combustion device for securing a fuel source and receiving fuel from the fuel source, comprising: a piston; a frame having a cylinder, the piston being positioned within the cylinder and dividing the cylinder into a combustion chamber and a purging chamber, the cylinder having an upper end and a lower end, the frame further having an exhaust port extending from the cylinder, an injection port for receiving fuel from the fuel source into the combustion chamber, and a conduit for routing air from the purging chamber to the combustion chamber; a conduit valve for allowing air from the conduit into the combustion chamber when open, and blocking air from entering the conduit from the combustion chamber when closed; a connecting rod attached to the piston and slidably extending from the cylinder lower end through the frame; a resilient bias member operationally connected to the connecting rod such that the piston is biased to return from a second position in the cylinder lower end, to a first position in the cylinder upper end; an igniter; and an actuator assembly operationally connected to the fuel source for causing the fuel source to deliver fuel to the combustion chamber for mixture with air in the combustion chamber, and operationally connected to the igniter for causing the igniter to ignite the fuel-air mixture, the resulting combustion event forcing the piston to move along a cylinder downstroke first length, wherein fresh air is forced out of the purging chamber through the exhaust port, and then along a cylinder downstroke second length, wherein fresh air is forced from the purging chamber through the conduit, the fresh air opening the conduit valve to allow fresh air into the combustion chamber, the fresh air expelling post-combustion fuel-air mixture from the cylinder through the exhaust port; and further wherein, when the piston completes the movement along the cylinder downstroke second length, the conduit valve closes and the bias member moves the piston back to the cylinder upper end, first along a cylinder upstroke first length, wherein the piston forces post-combustion combustion chamber contents through the exhaust port, then along a cylinder upstroke second length wherein fresh air from the conduit is trapped within the combustion chamber. In some exemplary embodiments, the conduit valve further comprises a conduit valve bias member, the conduit valve bias member being depressed by air moving through the conduit as the piston moves along the cylinder downstroke second length, allowing the conduit valve to open.

Our invention, in some exemplary embodiments, provides a method of starting a parent engine having a crankshaft, utilizing a single power stroke internal combustion engine having a cylinder and a piston positioned within the cylinder to form a combustion chamber and a purging chamber, the single power stroke engine being in communication with a fuel subsystem and operationally connected to a gear train which is operationally connected to the crankshaft of the parent engine, the method comprising: a. injecting fuel into the combustion chamber from the fuel subsystem; b. igniting the fuel within the combustion chamber, thereby causing the piston to move downward within the cylinder; c. as the piston travels downward within the cylinder, initiating the movement of the gear train in a first direction causing the crankshaft of the parent engine to rotate; d. simultaneously with step c., and as the piston moves downward, expelling air from the purging chamber and routing the air to the combustion chamber, the air entering the combustion chamber forcing spent gases from the combustion chamber through an exhaust port; e. decoupling the gear train from the parent engine crankshaft as the piston completes its downward travel; and f. returning the gear train and the piston to their original positions.

In some exemplary embodiments of our invention, we have provided an internal combustion device for starting a parent engine, the parent engine having a crankshaft, comprising: a frame having a cylinder and a piston in the cylinder forming a combustion chamber and a purging chamber, the frame further having means for receiving air and fuel into the combustion chamber; means for operationally connecting a gear train to a crankshaft of the parent engine; and means for initiating a combustion process using the received fuel and air within the combustion chamber, wherein the piston is driven one power stroke within the cylinder, causing the crankshaft of the parent engine to rotate. In some exemplary embodiments, the device further comprises means for routing air forced by the driven piston from the purging chamber to the combustion chamber during the one power stroke. In some exemplary embodiments, the device further comprises means for returning the piston to its position at the beginning of the one power stroke. In some exemplary embodiments, the device further comprises means for decoupling the gear train from the crankshaft of the parent engine such that the gear train is decoupled from the parent engine crankshaft as the piston completes the one power stroke.

DETAILED DESCRIPTION OF EXEMPLARY EMBODIMENTS

Figure 1:
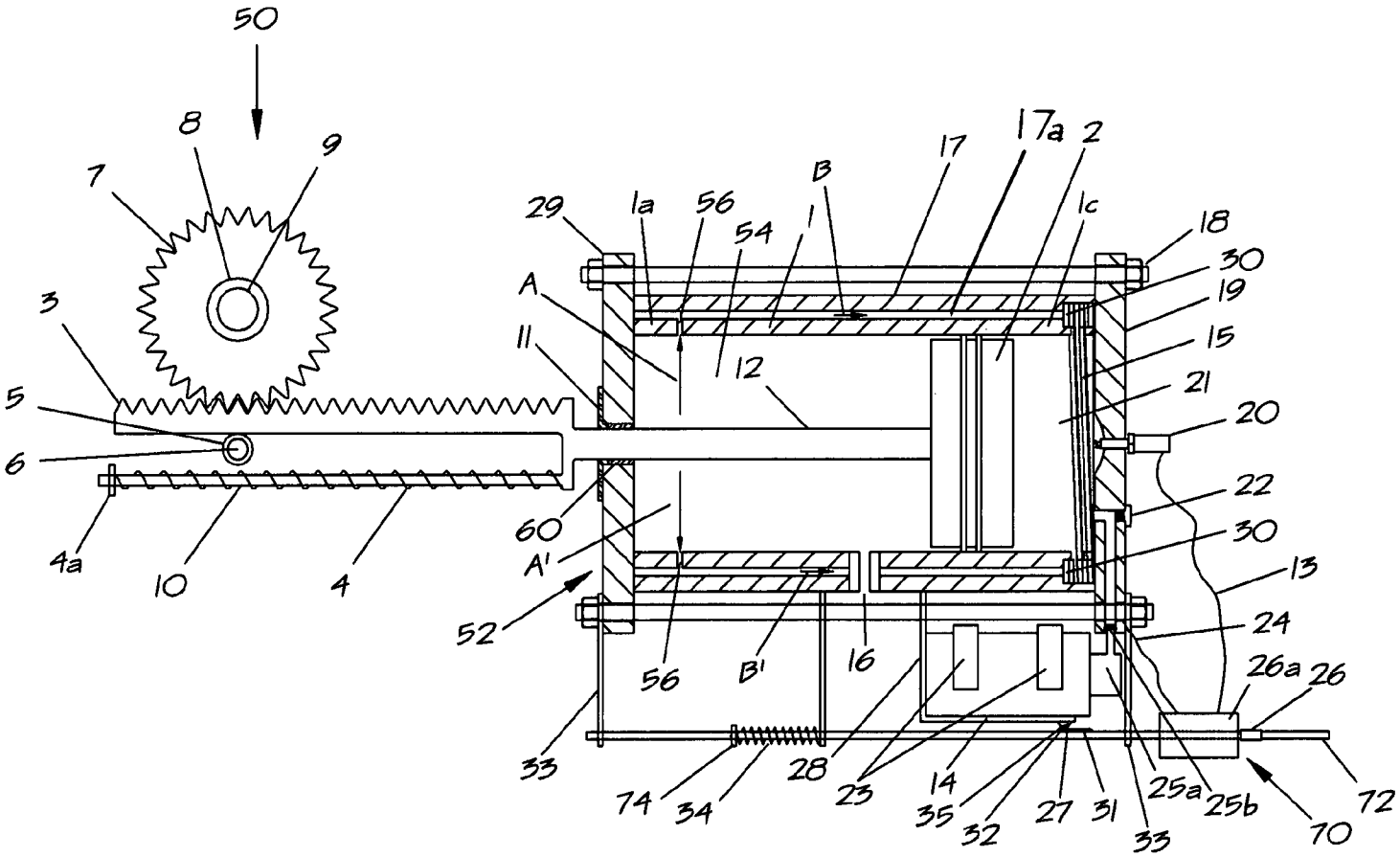
FIG. 1 is a cross-section of an exemplary embodiment of the device with the piston in the first position and air only in the combustion chamber.

The following discussion describes in detail exemplary embodiments of the invention. This discussion should not be construed, however, as limiting the invention to those particular embodiments. Practitioners skilled in the art will recognize numerous other embodiments as well.

FIGS. 1, 3–7, 11 illustrate an exemplary embodiment of the present invention in cross section. The device 50 cooperates with a fuel subsystem, that is, a replaceable compressed fuel canister 14 that is commercially available. The canister includes its own fuel metering valve 25 and discharge nozzle 25*a*. This type of canister releases fuel in a gaseous state in response to a slight bending of the discharge nozzle relative to the canister.

The device 50 includes a frame 52 having a cylinder 1, and a piston 2, the piston being positioned within the cylinder, using conventional rings 76, and dividing the cylinder into a combustion chamber 21 and a purging chamber 54, the cylinder having an upper end 1*c* and a lower end 1*a*. An exhaust port 16 extends from the cylinder.

Figure 2:
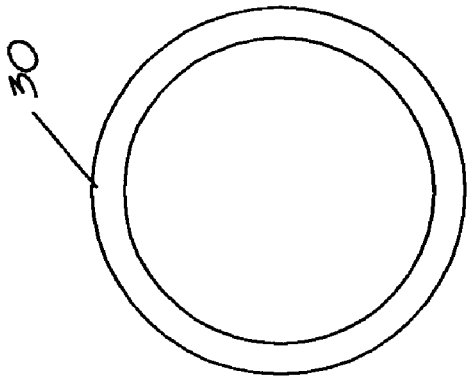
FIG. 2 is a frontal view of the conduit valve.

In this exemplary embodiment, purged air exit ports 56, allow air to exit the purging chamber, and the frame 52 includes a purging air shroud 17 placed about the cylinder 1, forming a purged air conduit 17*a* for routing air from the purging chamber to the combustion chamber. The purged air inlet ports 58 allow the air purged from the purging chamber into the combustion chamber when a conduit valve 30 opens in response to pressure from the purged air. In this exemplary embodiment, and as shown in FIG. 2, the conduit valve is a ring having a width sufficient to block the conduit completely when biased against the cylinder and purging air shroud by a spring 15 placed between the ring and a cylinder head 19. The conduit valve spring is sized to correspond to the conduit valve ring, thus providing an equal distribution of force about the ring's circumference.

The cylinder 1 and purging air shroud 17 are secured between the cylinder head 19 and a cylinder base plate 29, using cylinder head bolts 18. The cylinder head receives and positions an igniter 20, which in this exemplary embodiment is a spark plug. A cap screw 22 is positioned on the cylinder head to provide access to the combustion chamber. The cylinder base plate has a hole 60 that closely receives and positions a packing gland 11, through which a connecting rod 12 slidably extends, the rod being connected to the piston 2. A resilient bias member 4 cooperates with the connecting rod to bias the piston to a first position.

Figure 5:
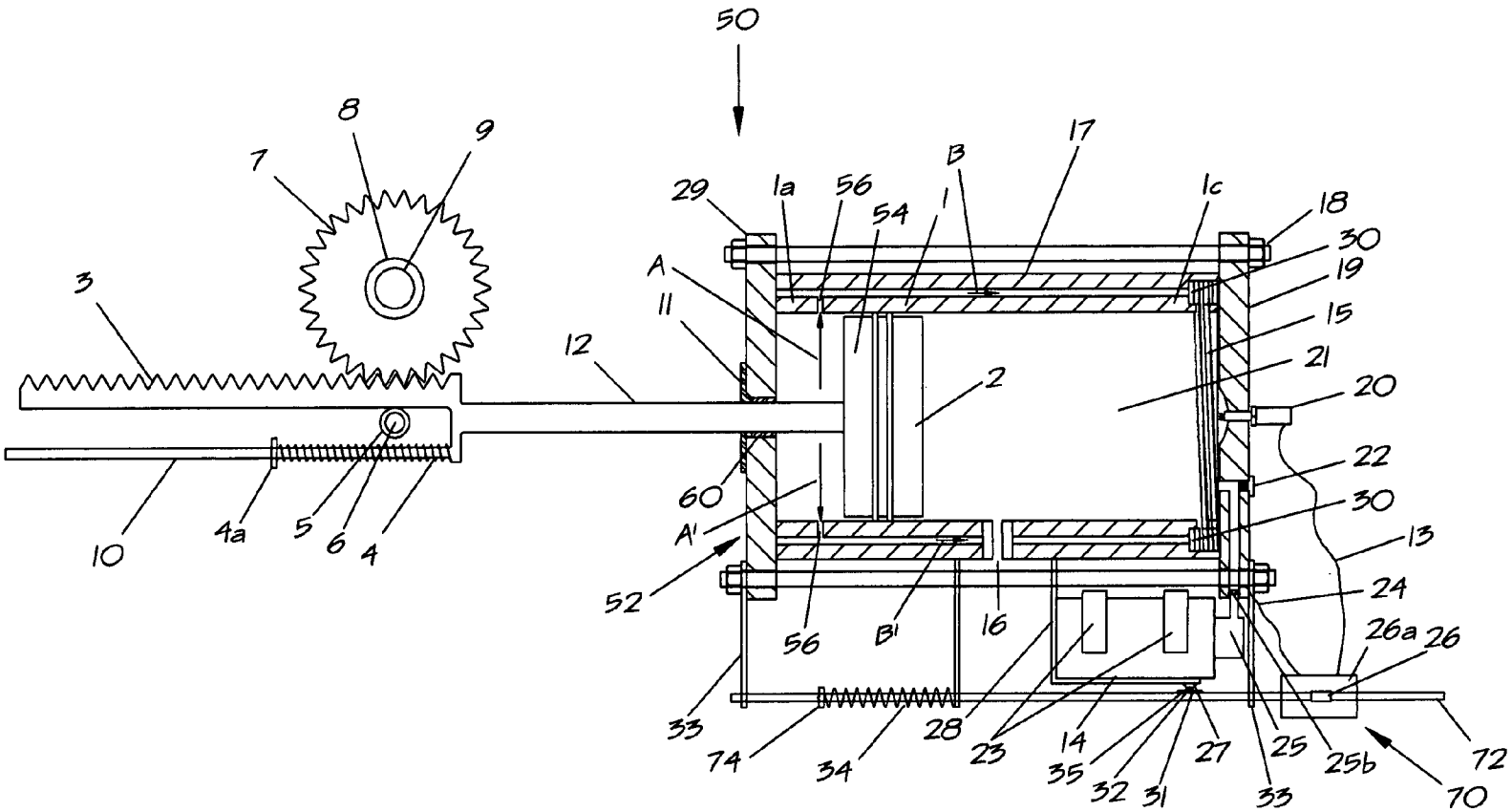
FIG. 5 is a cross-section depicting the actuating rod being forced from left to right, the cam follower retracted into the cam follower extension, and the actuating rod magnet in the magneto causing an electrical impulse to trigger the igniter, the combustion moving the piston to the second position.

In the exemplary embodiment of FIG. 1, the connecting rod bias member is a spring 4 positioned about a connecting rod shaft 10 and against structure 4*a* such that the spring is stretched when the piston moves from the first position (as shown in FIG. 1) to a second position (as shown in FIG. 5). In some exemplary embodiments the external structure 4*a* is part of the parent engine, while in other exemplary embodiments, the structure is part of the device, and is a conventionally attached extension or other member capable of withstanding the compression of the spring 4.

For the exemplary embodiment illustrated in FIG. 1, the connecting rod 12 includes a rack gear 3 that is operationally connected to the parent engine shaft 9 in a conventional manner. In this exemplary embodiment, the connecting rod rack gear is supported by a support bearing 5 on a support bearing shaft 6. In some exemplary embodiments, the support bearing and support-bearing shaft are part of the parent engine, while in other exemplary embodiments they are part of the device 50. The rack gear cooperates with a pinion gear 7 that is operationally connected with the parent engine shaft 9. A conventional unidirectional, one-way bearing 8 is provided that causes the parent engine shaft to rotate clockwise when the piston moves from the first to the second position, and causes the pinion gear 7 to decouple from and free-wheel about the parent engine shaft when the piston moves from the second to the first position.

In the exemplary embodiment illustrated in FIG. 2, an injection port 62 is provided for receiving fuel from the discharge nozzle 25*a* into the combustion chamber 21. The discharge nozzle is partially inserted within the injection port and is sealed therein with a sealing member 25*b*. The sealing member in this exemplary embodiment is an O-ring.

Figure 6:
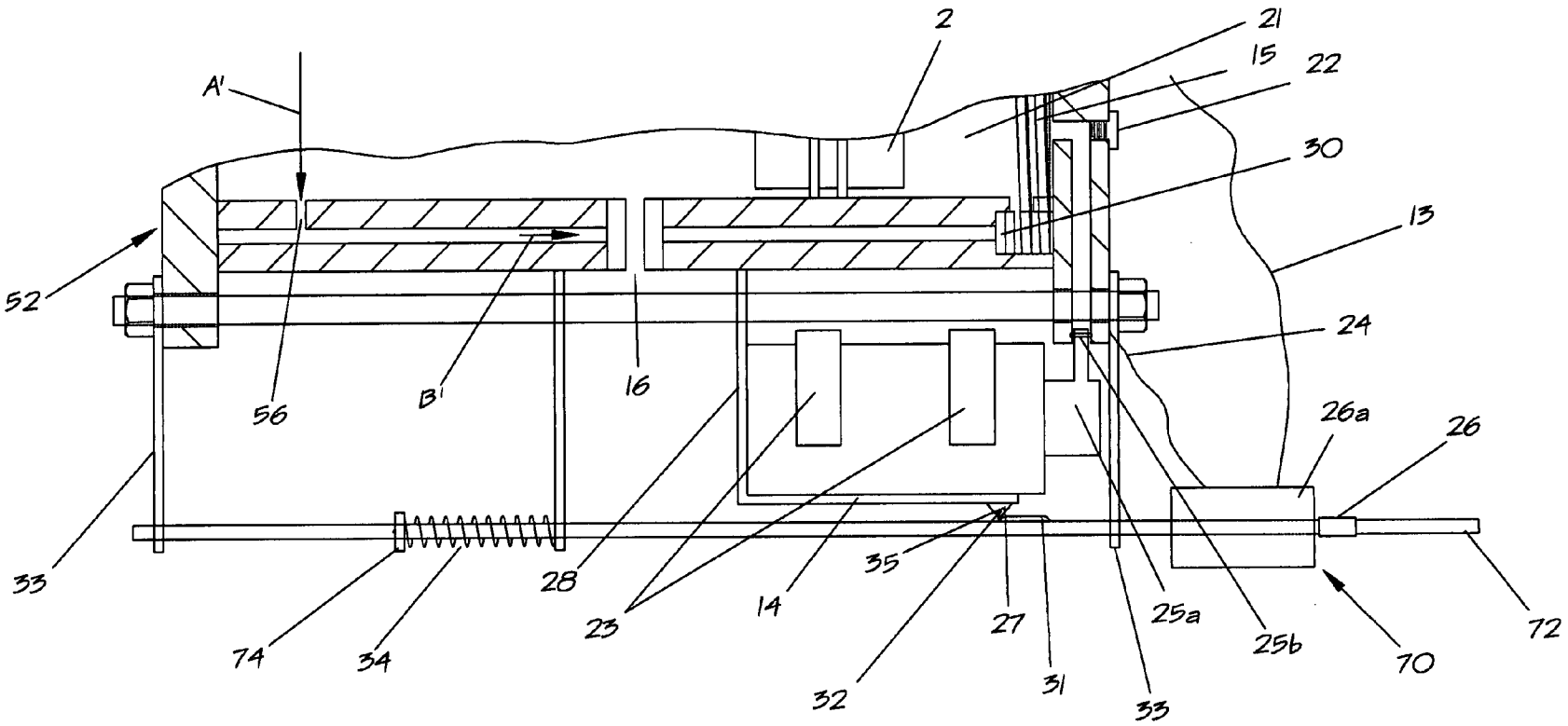
FIG. 6 is an enlarged cross-section of the actuating assembly with the components' positions corresponding to FIG. 1.
Figure 7:
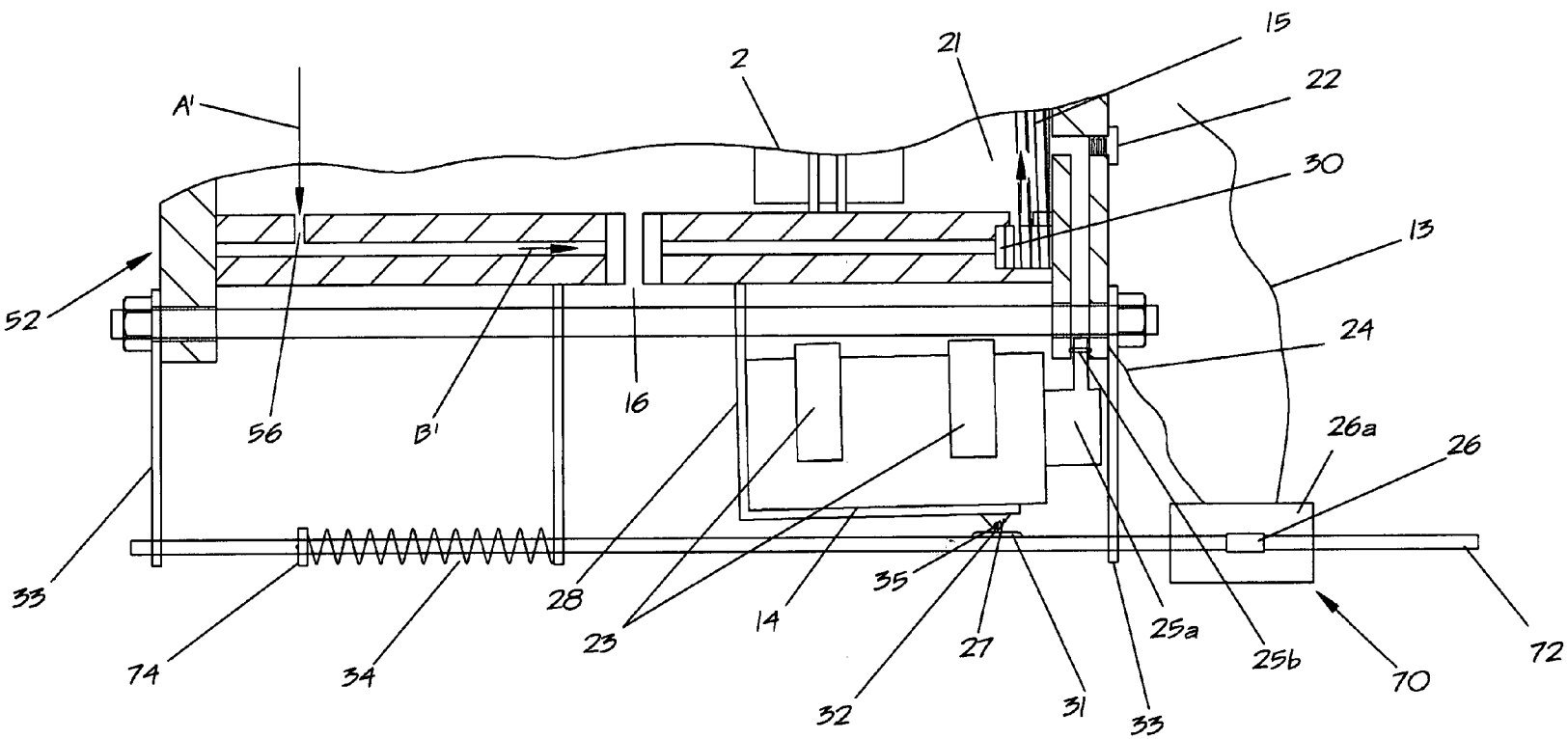
FIG. 7 is an enlarged cross-section of the actuating assembly with the components' positions corresponding to FIG. 3.

Turning now to FIGS. 6–7, an actuator assembly 70 is shown in closer detail for this exemplary embodiment, including a resilient fuel canister retaining member 28 with spring clips 23 that secure the fuel canister 14 proximate the frame 52. When the fuel canister is positioned in the canister retaining member 28 the canister discharge nozzle 25*a* is inserted into the injection port. The actuator assembly further includes an actuating rod 72 held in place by actuating rod supports 33, the rod being slidable within the supports. A bias member 34 is attached to the actuating rod at rod flange 74 and also to one of the actuating rod supports. In this exemplary embodiment the bias member is a spring that biases the actuating rod to a first position.

In the exemplary embodiment of FIGS. 5–6, the actuating rod 72 has a magnet 26 and the rod extends through a conventional magneto 26*a* with an interior coil. An ignition wire 13 extends from the magneto to the spark plug 20 and a ground wire 24 extends for grounding to the frame 52 or other external structure. The actuating rod further includes a cam 31 positioned on the rod near a fuel canister retaining member extension 27.

Figure 3:
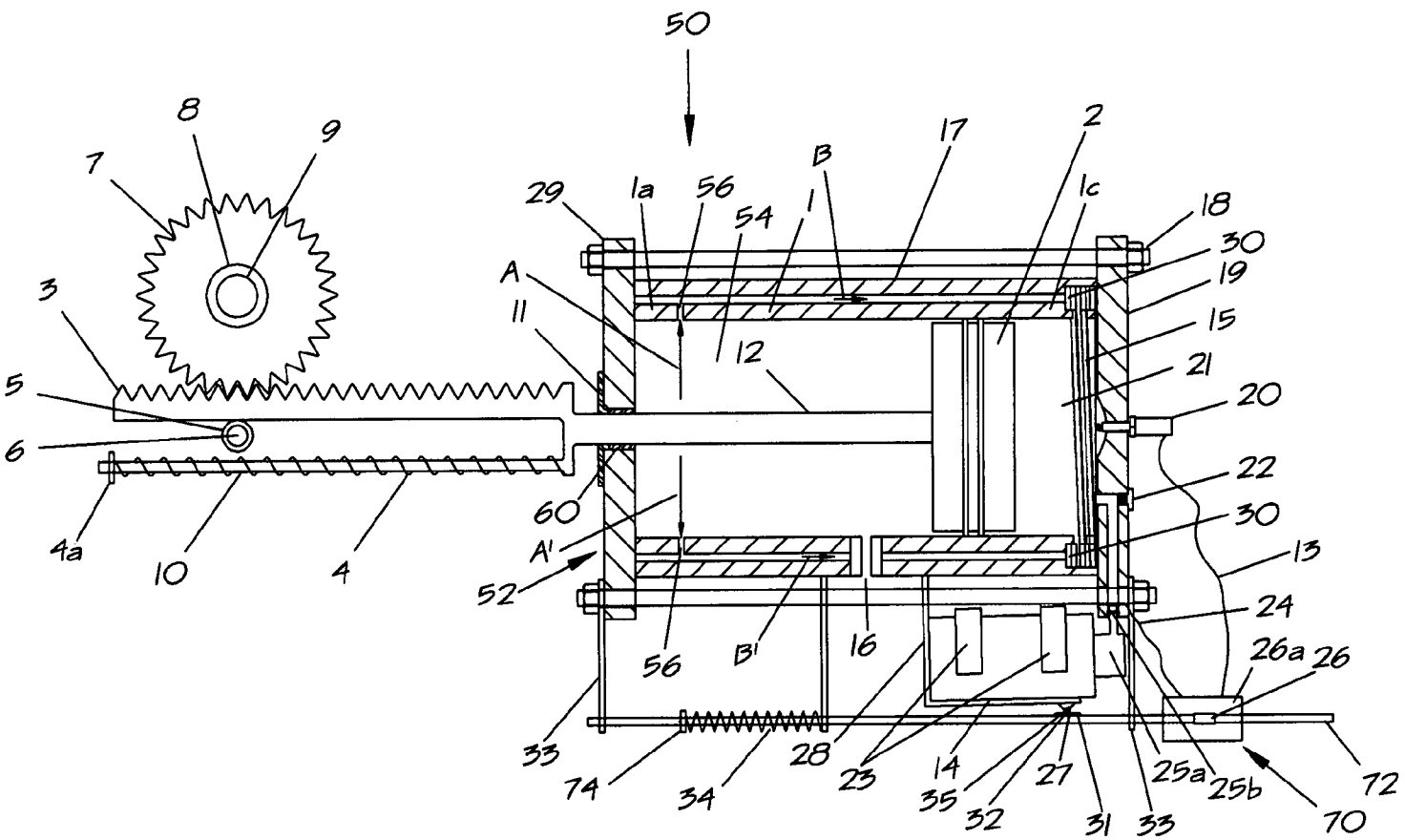
FIG. 3 is a cross-section depicting the actuating rod in a position moving from right to left, the cam follower on top of the cam, the canister angled and the canister nozzle bent discharging fuel into the combustion chamber.
Figure 8:
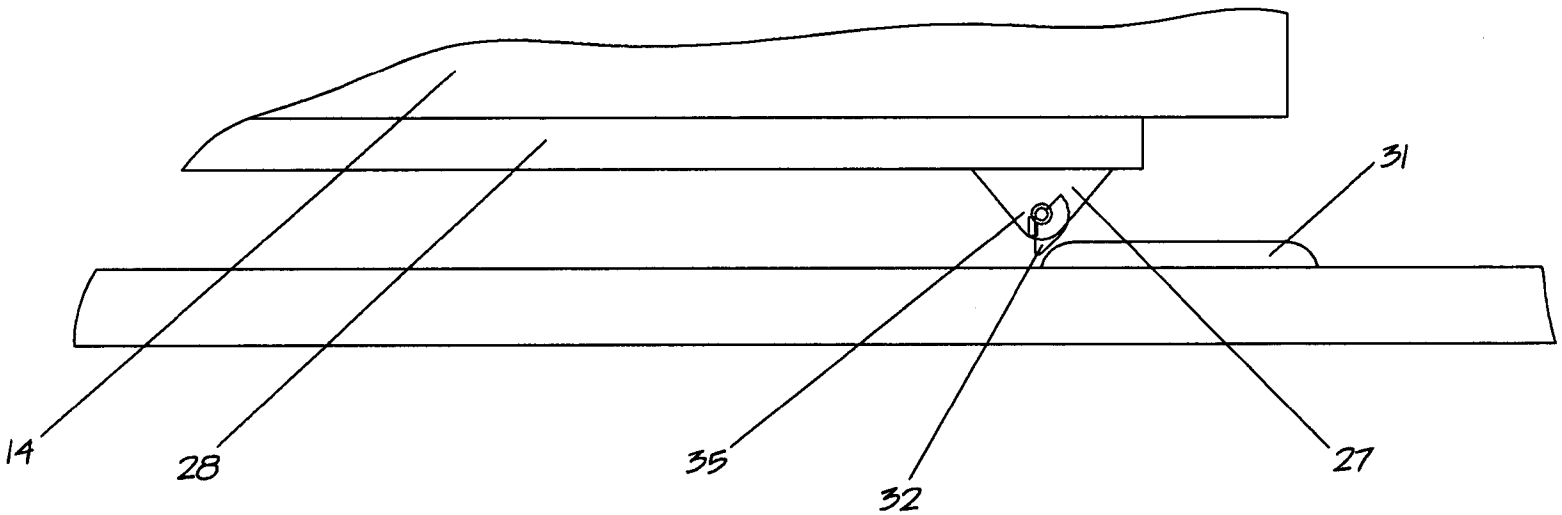
FIG. 8 is an enlarged cross-section of the cam, cam follower, cam follower extension, and actuating rod with the components' position corresponding to FIG. 1.
Figure 9:
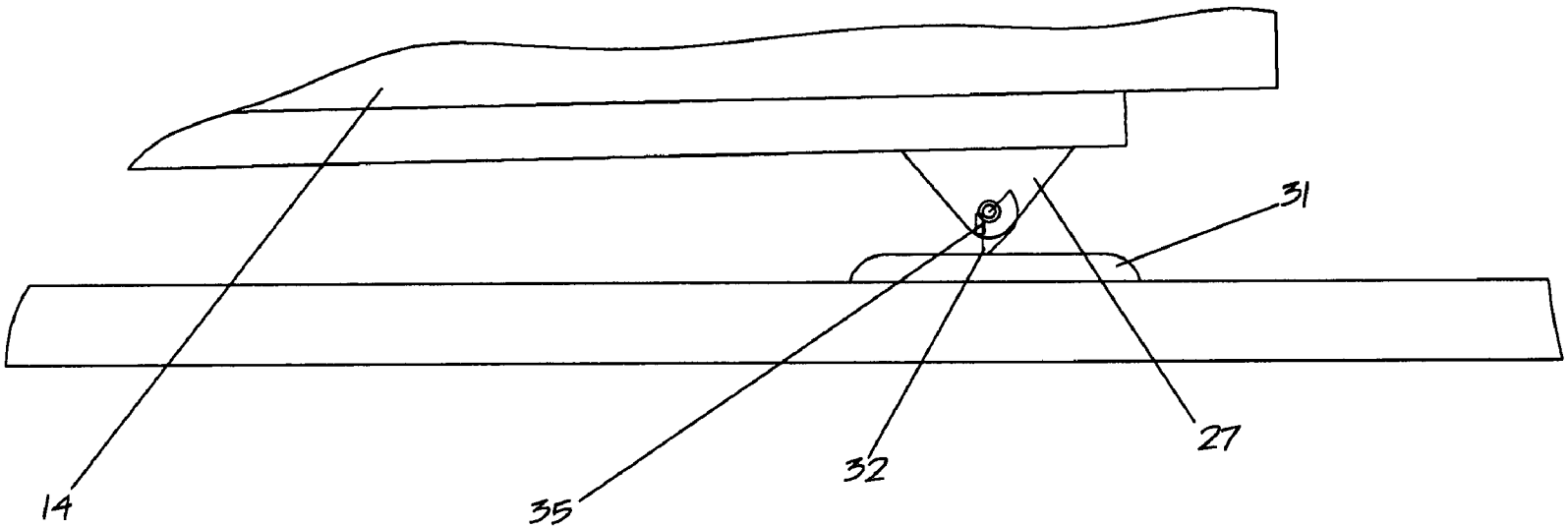
FIG. 9 is an enlarged cross-section of the cam, cam follower, cam follower extension, and actuating rod with the components' position corresponding to FIG. 3.
Figure 10:
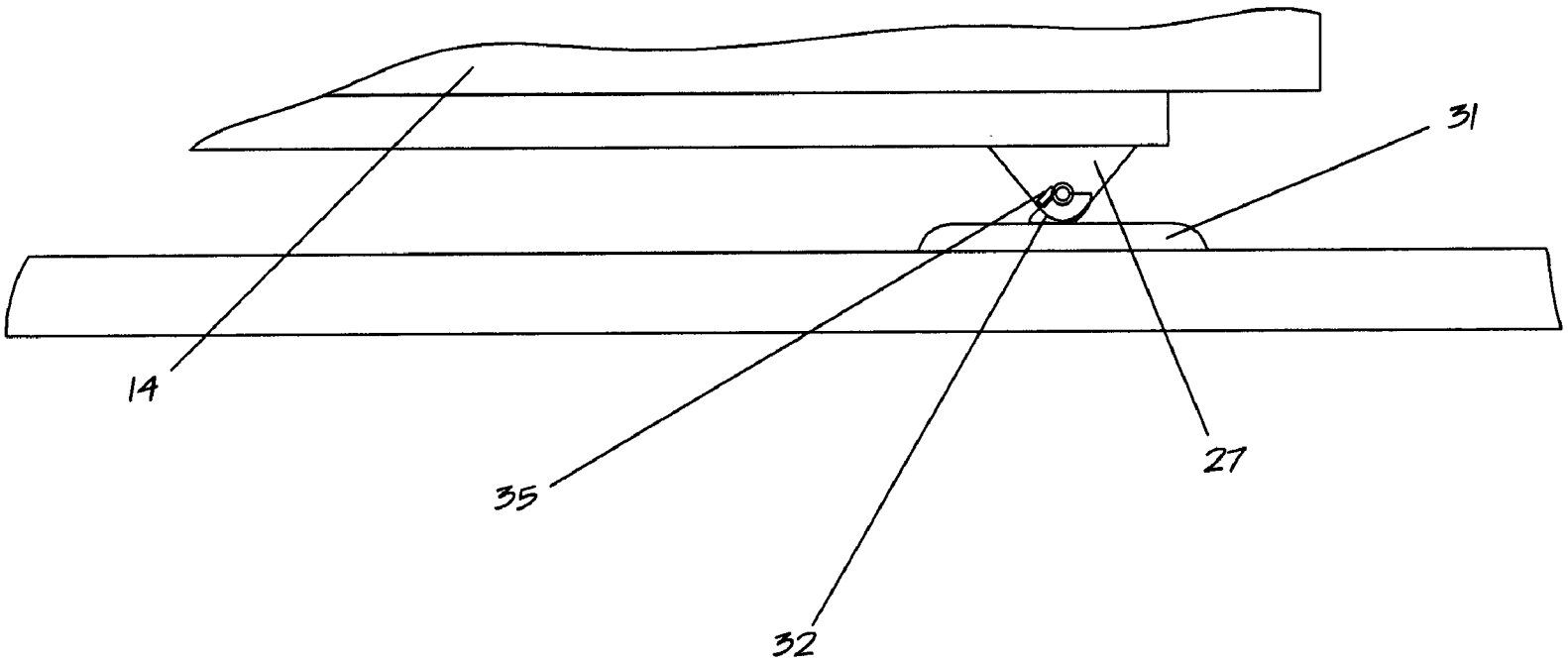
FIG. 10 is an enlarged cross-section of the cam, cam follower, cam follower extension, and actuating rod with the components' position corresponding to FIG. 5.
Figure 11:
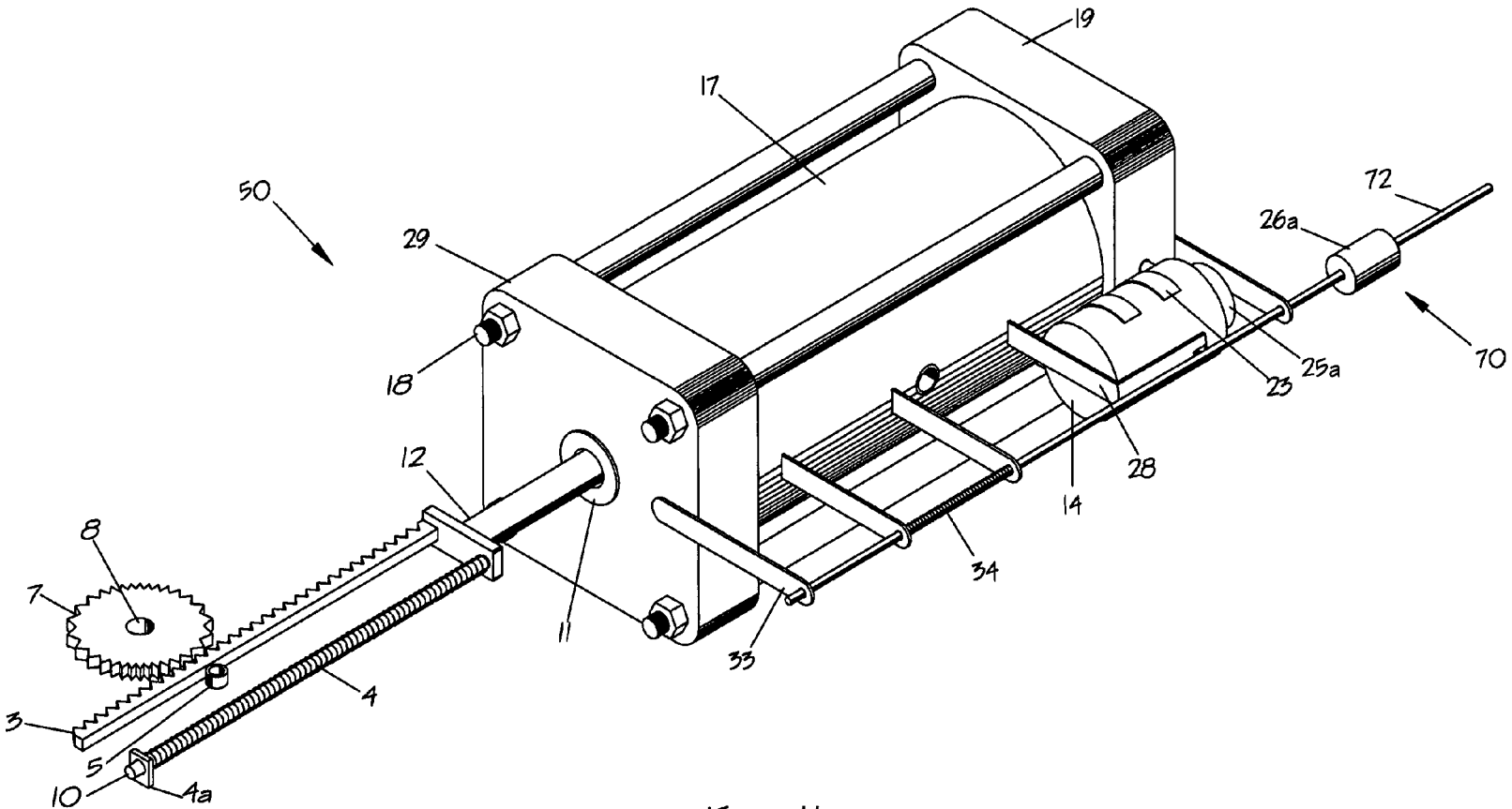
FIG. 11 is an isometric view of an exemplary embodiment of the present invention.

As shown in even closer detail in FIGS. 8–10, the fuel canister retaining member extension 27 positions a partially rotatable cam follower 32 against the actuating rod cam 31, such that when the actuating rod is moved in a left direction the cam follower cannot rotate because it is restrained by a fuel canister retaining member block 32. FIG. 8 depicts the cam follower prior to left movement of the actuating rod. The cam follower is rotatable but biased to a fully extended downward position against the actuating rod. As the actuating rod moves to the left, the cam follower moves upward and along the surface of the cam, thus pushing the fuel canister retaining member extension 27 upward, and causing the resilient fuel canister retaining member to bend. This cam follower position is shown in FIG. 9, and FIGS. 3,9 depict the device when the cam follower is on top of the cam. This fuel canister retaining member bending moves the fuel canister 14 relative to its discharge nozzle 25*a*, causing fuel to be released into the injection port 62. As the actuating rod completes its left motion, the cam follower descends from the cam as depicted in FIG. 10, and the canister retaining member returns to its original position with the canister again being flat, with the discharge nozzle straight, thus terminating the discharge of fuel from the canister. In this exemplary embodiment the amount of fuel released is dictated by the length of the cam.

Figure 4:
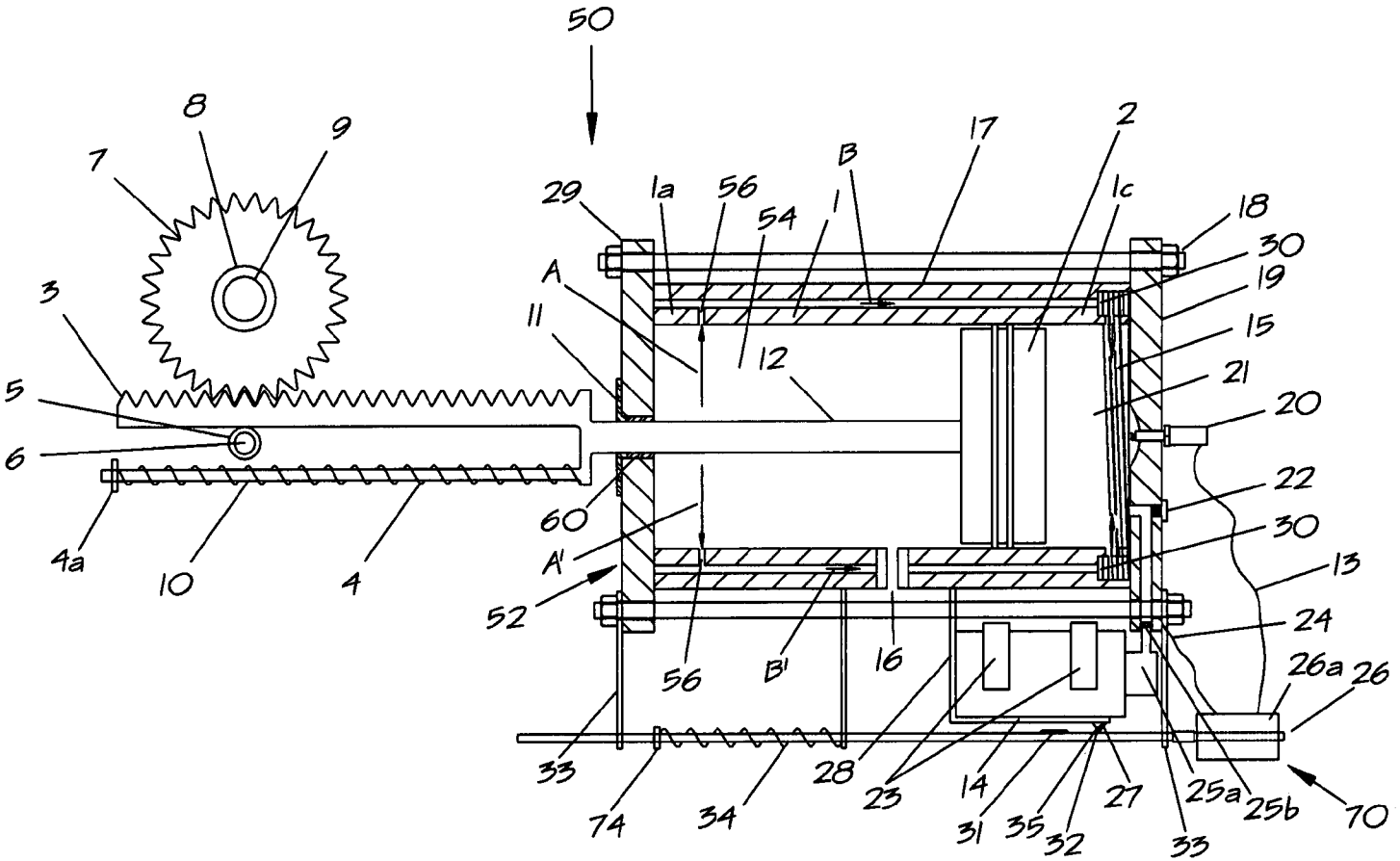
FIG. 4 is a cross-section depicting the actuating rod in the full left position, the cam follower off the cam, the canister flat and the canister nozzle straight, preventing the further discharge of fuel into the combustion chamber.

In this exemplary embodiment, the device components are in the position depicted in FIG. 1 immediately prior to use. To begin use the operator pushes the actuating rod 72 and the cam follower 32 lifts the canister retaining member 28 as the cam follower is elevated by the cam 31, as depicted in FIG. 3. As the canister retaining member is lifted the canister discharge member 28 is bent and fuel is discharged into the combustion chamber 21 through the injection port 62. The conduit valve 30 is in a closed position and the piston 2 is in the first position making the exhaust port 16 inaccessible, thus the fuel is trapped with existing air in the combustion chamber. As the operator finishes the complete left push on the actuating rod, the device components are positioned as shown in FIG. 4, with the cam follower to the right of the cam and such that the canister retaining member is lowered to its original position, with the canister being flat and the discharge nozzle straight, thus completing the fuel discharge into the combustion chamber. In this full left position the actuating rod spring 34 is stretched.

When the operator releases the actuating rod 72 the actuating rod spring 34 contracts and starts the actuating rod in a right movement. As the actuating rod moves to the right the cam follower encounters the cam 31, but is rotated into the canister retaining member extension, such that the canister retaining member is not lifted, the canister is not moved and the canister nozzle remains straight. No fuel is discharged as the actuating rod moves to the right. During this right movement, and as shown in FIG. 5, the actuating rod magnet 26 is rapidly pulled through the magneto 26*a* and an electric pulse is delivered along the ignition wire 13 causing the spark plug 20 to fire, thus igniting the fuel and air in the combustion chamber 21. The resulting combustion forces the piston 2 to move in a left direction along a cylinder downstroke first length, wherein fresh air is forced out of the purging chamber 54 through the exhaust port 16 (while forming an air buffer in the purging chamber to control the piston speed), and then along a cylinder downstroke second length, wherein fresh air is forced from the purging chamber through the purged air exit ports 56, through the purged air conduit 17*a*, the fresh air opening the conduit valve 30 against the conduit valve spring 15 to allow fresh air into the combustion chamber, the fresh air expelling post-combustion fuel-air mixture from the cylinder 1 through the exhaust port. During this movement of the piston, the connecting rod 12 is moved through the packing gland 11 and the rack gear 3 rotates the pinion gear 7. Rotation of the pinion gear causes the parent engine shaft 9 to rotate thus initiating the starting sequence within the parent engine.

As the piston 2 completes this movement in response to the combustion event it is in its second position with the connecting rod spring 4 compressed. At this point, the conduit valve bias member 15 closes the conduit valve 30, and the connecting rod spring moves the piston back to the cylinder upper end 1*c*, in a right direction, first along a cylinder upstroke first length, wherein the piston forces some of the post-combustion combustion chamber contents through the exhaust port 16, and then along a cylinder upstroke second length wherein fresh air from the conduit is trapped within the combustion chamber 21. At the completion of the piston right movement, the device components are again in the position shown in FIG. 1.

In the exemplary embodiment depicted in FIG. 1, the magneto 26*a* is a conventional magneto device that generates an electrical impulse when the steel magnet 26 is drawn through its coil. The conduit valve 30, conduit valve bias member 15, cylinder head bolts 18, connecting rod 12, rack gear 3, fuel canister retaining member 28, and its spring clips 23, are made from stainless steel. The piston rings 76 and frame 52 are constructed from cast iron. The piston 2, cylinder 1, actuating rod 72, purging air shroud 17, cylinder base plate 29, cam 31, cam follower 32, fuel canister retaining member extension 27, connecting rod spring 4, actuating rod spring 34, and cylinder head 19 are made from aluminum. The fuel canister 14 is a commercially available device which discharges compressed butane or propane fuel when the nozzle 25*a* is bent. The nozzle O-ring 25*b* is a conventional, rubber O-ring.

With respect to the above description then, it is to be realized that the optimum device configuration for the particular situation, will include variations in the device shape, size, and component materials that will occur to those skilled in the art upon review of the present disclosure.

All equivalent relationships to those illustrated in the drawings and described in the specification and claims are intended to be encompassed by the present invention. The descriptions in this specification are for purposes of illustration only and are not to be construed in a limiting sense.

We claim:

1. An internal combustion device for starting a parent engine, the parent engine having a crankshaft, comprising:

a frame having a cylinder and a piston in the cylinder forming a combustion chamber, the frame further having an air passage and a fuel passage for receiving air and fuel into the combustion chamber;

a rod interconnecting the piston to a gear train, the gear train being operationally connected to a crankshaft of the parent engine; and an ignition mechanism operationally connected to the combustion chamber, the ignition mechanism for initiating a combustion process using the received fuel and air within the combustion chamber, wherein the piston is driven one power stroke within the cylinder, causing the crankshaft of the parent engine to rotate; and further wherein the cylinder has a lower end and an upper end, and further wherein the piston within the cylinder forms a purge chamber, the device further comprising a purging air shroud about the cylinder forming a purged air conduit, the purged air conduit extending from the lower end of the cylinder to the upper end of the cylinder, such that air purged from the purging chamber enters the purged air conduit and flows through the conduit into the combustion chamber.

2. The internal combustion device of claim 1, further comprising a resilient bias member operationally connected to the rod such that the piston is biased to return from a second position in the cylinder lower end, to a first position in the cylinder upper end.

3. The internal combustion device of claim 1, further comprising a decoupling mechanism operationally connecting the gear train to the crankshaft of the parent engine such that as the parent engine begins to rotate independently the gear train is decoupled from the parent engine.

4. The internal combustion device of claim 1, further comprising a fuel subsystem in operative communication with the frame wherein a controlled amount of fuel is supplied into the combustion chamber.

5. The internal combustion device of claim 4, further comprising an actuator assembly operationally connected to the fuel subsystem for causing the fuel subsystem to deliver the fuel to the combustion chamber for mixture with the air in the combustion chamber, and operationally connected to the ignition mechanism for causing the ignition mechanism to ignite the fuel-air mixture.

6. The internal combustion device of claim 1, wherein the piston travel, following combustion, compresses air in the purging chamber, forms an air buffer for controlling piston speed during the power stroke.

7. An internal combustion device for securing a fuel source and receiving fuel from the fuel source, comprising:

a piston;

a frame having a cylinder, the piston being positioned within the cylinder and dividing the cylinder into a combustion chamber and a purging chamber, the cylinder having an upper end and a lower end, the frame further having an exhaust port extending from the cylinder, an injection port for receiving fuel from the fuel source into the combustion chamber, and a conduit for routing air from the purging chamber to the combustion chamber;

a conduit valve for allowing air from the conduit into the combustion chamber when open, and blocking air from entering the conduit from the combustion chamber when closed;

a connecting rod attached to the piston and slidably extending from the cylinder lower end through the frame;

a resilient bias member operationally connected to the connecting rod such that the piston is biased to return from a second position in the cylinder lower end, to a first position in the cylinder upper end;

an igniter; and an actuator assembly operationally connected to the fuel source for causing the fuel source to deliver fuel to the combustion chamber for mixture with air in the combustion chamber, and operationally connected to the igniter for causing the igniter to ignite the fuel-air mixture, the resulting combustion event forcing the piston to move along a cylinder downstroke first length, wherein fresh air is forced out of the purging chamber through the exhaust port, and then along a cylinder downstroke second length, wherein fresh air is forced from the purging chamber through the conduit, the fresh air opening the conduit valve to allow fresh air into the combustion chamber, the fresh air expelling post-combustion fuel-air mixture from the cylinder through the exhaust port;

and further wherein, when the piston completes the movement along the cylinder downstroke second length, the conduit valve closes and the bias member moves the piston back to the cylinder upper end, first along a cylinder upstroke first length, wherein the piston forces post-combustion combustion chamber contents through the exhaust port, then along a cylinder upstroke second length wherein fresh air from the conduit is trapped within the combustion chamber.

8. The device of claim 7, wherein the conduit valve further comprises a conduit valve bias member, the conduit valve bias member being depressed by air moving through the conduit as the piston moves along the cylinder downstroke second length, allowing the conduit valve to open.

9. A method of starting a parent engine having a crankshaft, utilizing a single power stroke internal combustion engine having a cylinder and a piston positioned within the cylinder to form a combustion chamber and a purging chamber, the single power stroke engine being in communication with a fuel subsystem and operationally connected to a gear train which is operationally connected to the crankshaft of the parent engine, the method comprising:

a. injecting fuel into the combustion chamber from the fuel subsystem;

b. igniting the fuel within the combustion chamber, thereby causing the piston to move downward within the cylinder;

c. as the piston travels downward within the cylinder, initiating the movement of the gear train in a first direction causing the crankshaft of the parent engine to rotate;

d. simultaneously with step c., and as the piston moves downward, expelling air from the purging chamber and routing the air to the combustion chamber, the air entering the combustion chamber forcing spent gases from the combustion chamber through an exhaust port;

e. decoupling the gear train from the parent engine crankshaft as the piston completes its downward travel; and f. returning the gear train and the piston to their original positions.

10. An internal combustion device for starting a parent engine, the parent engine having a crankshaft, comprising:

a frame having a cylinder and a piston in the cylinder forming a combustion chamber and a purging chamber, the frame further having means for receiving air and fuel into the combustion chamber;

means for operationally connecting a gear train to a crankshaft of the parent engine; and means for initiating a combustion process using the received fuel and air within the combustion chamber, wherein the piston is driven one power stroke within the cylinder, causing the crankshaft of the parent engine to rotate.

11. The device of claim 10, further comprising means for routing air forced by the driven piston from the purging chamber to the combustion chamber during the one power stroke.

12. The internal combustion device of claim 10, further comprising means for returning the piston to its position at the beginning of the one power stroke.

13. The internal combustion device of claim 10, further comprising means for decoupling the gear train from the crankshaft of the parent engine such that the gear train is decoupled from the parent engine crankshaft as the piston completes the one power stroke.

14. An internal combustion device for starting a parent engine, the parent engine having a crankshaft, comprising:

a frame having a cylinder and a piston in the cylinder forming a combustion chamber, the frame further having an air passage and a fuel passage for receiving air and fuel into the combustion chamber;

a rod interconnecting the piston to a gear train, the gear train being operationally connected to a crankshaft of the parent engine; and an ignition mechanism operationally connected to the combustion chamber, the ignition mechanism for initiating a combustion process using the received fuel and air within the combustion chamber, wherein the piston is driven one power stroke within the cylinder, causing the crankshaft of the parent engine to rotate;

the device further comprising a fuel subsystem in operative communication with the frame wherein a controlled amount of fuel is supplied into the combustion chamber, and an actuator assembly operationally connected to the fuel subsystem, for causing the fuel subsystem to deliver the fuel to the combustion chamber for mixture with the air in the combustion chamber, the actuator assembly being operationally connected to the ignition mechanism for causing the ignition mechanism to ignite the fuel-air mixture.

* * * * *